United States Patent [19]

Inoue

[11] Patent Number: 4,626,488

[45] Date of Patent: Dec. 2, 1986

[54] POLYMERIC BINDER FOR TONER HAVING SPECIFIC WEIGHT DISTRIBUTION

[75] Inventor: Sukejiro Inoue, Yokohama, Japan

[73] Assignee: Canon Kabushiki Kaisha, Tokyo, Japan

[21] Appl. No.: 714,520

[22] Filed: Mar. 21, 1985

[30] Foreign Application Priority Data

Apr. 28, 1984 [JP] Japan ..... 59-86767

[51] Int. Cl.[4] ..... G03G 9/08

[52] U.S. Cl. ..... 430/109; 430/126; 430/904

[58] Field of Search ..... 430/109, 99, 126, 904

[56] References Cited

U.S. PATENT DOCUMENTS 4,486,524 12/1984 Fujisaki ..... 430/109

*Primary Examiner*—John L. Goodrow

*Attorney, Agent, or Firm*—Fitzpatrick, Cella, Harper & Scinto

[57] ABSTRACT

A toner for developing electrostatic image excellent in harmonization of hot roller fixability, anti-offset characteristic and durability is provided by melt-kneading a binder resin and a colorant and pulverizing the kneaded product. The binder resin comprises a polymer having at least three peaks or shoulders in its chromatogram obtained by gel permeation chromatography, wherein the at least three peaks or shoulders include a peak or shoulder A having the largest molecular weight Ma of 2,000 to 80,000, a peak or shoulder C having the smallest molecular weight Mc satisfying, the relationship of $Mc/Ma \geqq 150$, and a peak or shoulder B having an intermediate molecular weight between the Ma and Mc.

34 Claims, 1 Drawing Figure

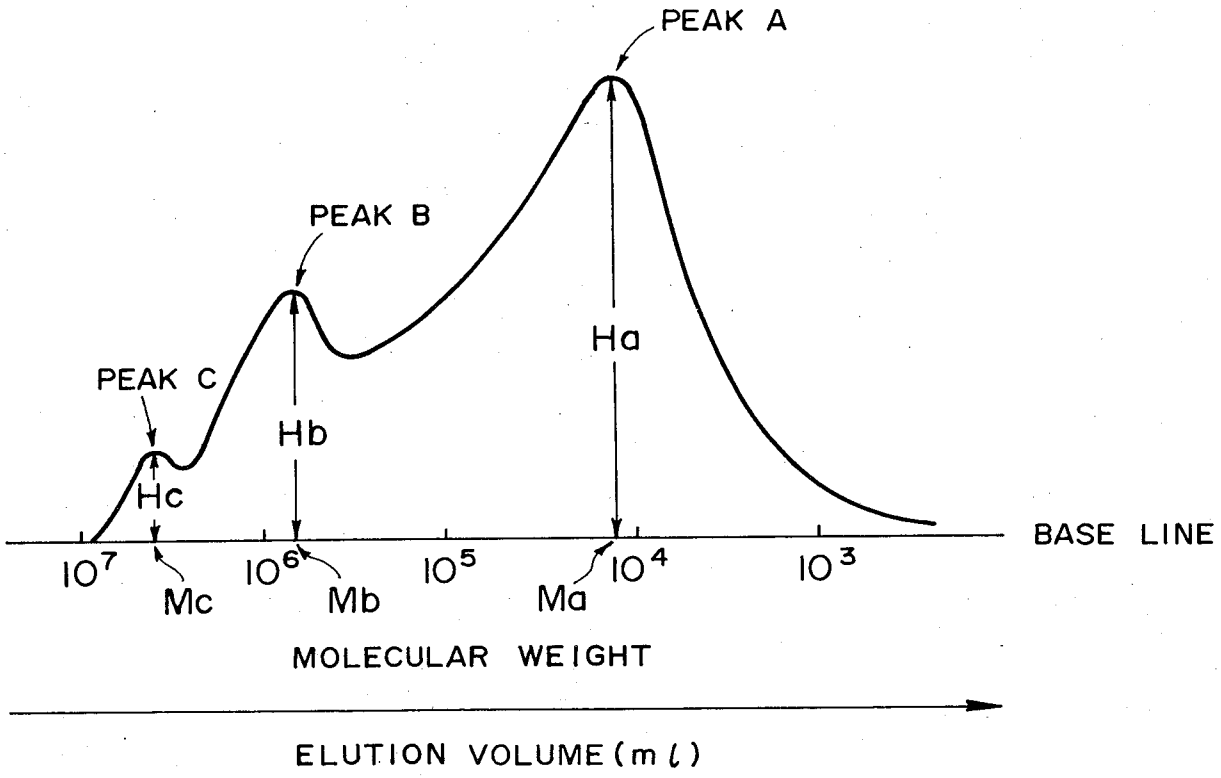
PEAK A
PEAK B
PEAK C
Ha
Hb
Hc
BASE LINE
$10^3$
$10^4$
$10^5$
$10^6$
$10^7$
Ma
Mb
Mc
MOLECULAR WEIGHT
ELUTION VOLUME (ml)

POLYMERIC BINDER FOR TONER HAVING SPECIFIC WEIGHT DISTRIBUTION

BACKGROUND OF THE INVENTION

The present invention relates to a toner binder resin for a dry-system developer for use in electrophotography, electrostatic printing, magnetic recording, etc., a toner containing the binder resin and processes for producing the binder resin and the toner.

Heretofore, as electrophotographic processes, a large number of processes have been known, including those disclosed in U.S. Pat. No. 2,297,691; and Japanese Patent Publication Nos. 23910/1967 and 24748/1968. These processes comprise the steps of forming an electrical latent image on a photosensitive member generally comprising a photoconductive material, subsequently developing the latent image with a toner, and optionally transferring the resultant toner image onto a transfer material such as paper and fixing the toner image by means of heat, pressure, solvent vapor, etc., thereby to obtain a copy. Where the step for transfering the toner image is included, there is also provided a step for removing residual toner.

Further, several developing methods have been known for visualizing electrical latent images, such as the magnetic brush method as disclosed in U.S. Pat. No. 2,874,063, the cascade developing method as disclosed in U.S. Pat. No. 2,618,552, the powder cloud method as disclosed in U.S. Pat. No. 2,221,776, and a method using an electroconductive magnetic toner as disclosed in U.S. Pat. No. 3,909,258.

The toner used in these developing methods conventionally comprises fine particles of a natural or synthetic resin and a dye or pigment dispersed therein. For example, fine particles with a size of the order of 1 to 30μ obtained by micropulverizing an intimate mixture of a binder resin such as polystyrene and a colorant dispersed therein, have been used as a toner. A magnetic toner is one containing particles of a magnetic material such as magnetite. In a system using a so-called two-component developer, a mixture of such a toner with carrier particles such as glass beads or iron powder is ordinarily used.

For the toner, although various physical and chemical properties are required, most known toners have a number of defects as explained hereinbelow. Thus, many of the toners readily fusible upon heating are liable to solidify or agglomerate during storage or in a copying machine. Many toners have poor triboelectric characteristics and poor free-flowability due to temperature change in the environment. Further, in the continuous use of many toners involving repetitive development, the density of the image is changed or the background density increases due to mutual deterioration of the toner, carrier particles and photosensitive member through collision between the toner particles and carrier particles, and contact between these particles and the photosensitive member. Further, many toners ordinarily cause background density to increase, resulting in so-called fogging, when it is actually intended to increase the density of copied images by increasing the amount of toner attached to the photosensitive member having a latent image.

One of these undesirable phenomena is caused by the fragility of a toner. That a toner is fragile means that the toner is readily pulverized by a mechanical power and is a desirable feature from the viewpoint of the productivity of a toner. However, a fragile toner is readily pulverized into fine powder even under a normal load applied thereto in a developing apparatus, thereby to cause undesirable phenomena such as fogging through contamination of carrier particles, soiling of a developer sleeve, and imperfect charge controlling characteristic of the toner particles per se. Thus, the fragility of a toner significantly affects the life of the developer. In order to obviate such deterioration, it is conceivable to use a polymer of a high molecular weight as a binder resin for the toner. However, use of such a high-molecular weight polymer is not desirable from the viewpoint of economization of energy consumption, because it requires a larger amount of heat due to elevation of a fixation temperature when the ordinary heat-fixation of images is carried out in the final step of the copying process. Further, in order to remove this drawback, it has been proposed to add a small amount of plasticizer into a toner, but such a proposal has not been necessarily successful because it is accompanied with problems such as decrease in free-flowability of the toner and contamination of the carrier particles. On the other hand, if a toner is too hard, practical production thereof becomes difficult because mechanical pulverization becomes nearly impossible.

For the above reasons, polystyrene, a styrenebutyl methacrylate copolymer or the like of a relatively low molecular weight of the order of several thousands having an appropriate hardness or rigidity has heretofore been used as a binder resin for toner. On the other hand, manufacturers are trying to produce copying machines and toners having decreased, or maintenance free, operation. It has been determined that, under these conditions, a relatively low molecular-weight polystyrene or styrene-butyl methacrylate copolymer is not sufficient in hardness, and a material with a higher hardness is required. Further, this class of ordinary binder resin is not especially suited for heat fixation by means of hot rollers which are the most widely adopted fixing means. More specifically, the binder resin is best adapted for giving a toner with good fixation characteristic, i.e., good adhesion thereof to a transfer medium such as paper through fusion of the binder on heating and pressure-application. However it is difficult to obviate the soiling of the heat rollers due to sticking of the toner onto the rollers, i.e., so-called offsetting. For this reason, silicone oil has been applied by adding a complicated mechanism, although such a measure is not completely satisfactory for removing offsetting and is disadvantageous from the points of cost as well as maintenance. Thus, development of a toner binder free of such a problem is desired. Several measures have been previously proposed, including changing binder components in various manners, various means such as crosslinking and others for adjusting the molecular weight of binder. There has also been adopted a measure of incorporating an additive such as a low-molecular weight polyolefin or another plasticizer into a toner. The incorporation of such an additive is, however, accompanied with various problems such as poor dispersibility with the binder, impairment of free flowability of the toner powder and the promotion of toner agglomeration, and a satisfactory additive has not been found so far.

As explained hereinabove, improvement of toner performances by the use of additives is limited, and improvement of the resin component which is a principal binder component is believed to be the most important. There have been some proposals of adjusting the molecular weight of a binder resin. These proposals are not more than saying that it is desired to broaden the molecular weight distribution by applying crosslinking and do not clarify what range of molecular weight distribution is desirable. The proposals made heretofore refer to a binder resin having a single peak in the molecular weight distribution and having an average molecular weight in a certain range, or to a binder resin further defined by a broadness of the molecular weight distribution in terms of a dispersion (more specifically, a ratio (Mw/Mn) of weight-average molecular weight (Mw)/number-average molecular weight (Mn) obtained by gel permeation chromatography (hereinafter, sometimes abbreviated as "GPC")). However, none of this category of binder polymers satisfies the overall requirements, particularly the overall fixation performances, including various characteristics as described hereinabove required for heat-fixable dry-system developers.

Further, binder resins having a molecular weight distribution satisfying certain relationships have been proposed. For example, Japanese Patent Laid-Open Applications Nos. 16144/1981 and 82258/1983 propose methods for improving the fixing characteristics of a toner by mixing a plurality of binder resins having different molecular weight ranges. Especially, Japanese Patent Laid-Open Application No. 82258/1983 discloses a binder having three peaks in the molecular weight distribution, which gives an improvement in the fixing characteristics. However, a binder resin only comprising three components of different molecular weights does not provide a satisfactory combination of fixability and anti-offset property on heat-fixation by means of heat rollers but still involves some problem in durability.

SUMMARY OF THE INVENTION

An object of the present invention is to provide a binder resin for toner free of the above-mentioned defects of the conventional toners and giving a toner with excellent physical and chemical properties, a toner containing the binder resin and processes for producing the same.

Another object of the present invention is to provide a binder resin for toner suitable for fixation by hot rollers, a toner for hot roller fixation containing the binder resin, and processes for producing the same.

A still further object of the present invention is to provide a toner binder resin for giving a toner excellent in overall characteristics on hot roller fixation, i.e., combination of characteristics such as capability of being fixed at a relatively small amount of heat, substantial freeness from offsetting to hot rollers, and capability of realizing smooth discharge of paper, a toner containing the binder resin, and processes for producing the same.

A still another object of the present invention is to provide a binder resin capable of giving a toner excellent in impact resistance, free-flowability without causing agglomeration and excellent in durability, a toner containing the binder resin, and processes for producing the same.

A further object of the present invention is to provide a binder resin for giving a toner less-sticky to related members such as a carrier, a toner holding member, a photosensitive member and a cleaning blade and giving less damage to the related members, a toner containing the binder resin, and processes for producing the same.

A still further object of the present invention is to provide a binder resin for giving a toner capable of producing constantly stable clear images free of fogging, a toner containing the binder resin and processes for producing the same.

As a result of my further study, it has been found that a binder resin having a molecular weight as well as a molecular weight distribution which are more specific than those of the known binder resins is effective for accomplishing the above objects. Particularly, I have found that it is not necessarily sufficient for a binder resin to have at least three peaks or shoulders in its molecular weight distribution curve as exemplified in the above-mentioned Japanese Patent Laid-Open Application No. 82258/1983, and that it is critical that the binder resin has a sufficient molecular weight distance between the peaks corresponding to the largest and smallest molecular weights among the at least three peaks or shoulders.

Thus, according to one aspect of the present invention there is provided a binder resin for a toner comprising a polymer having at least three peaks or shoulders in its chromatogram obtained by gel permeation chromatography, wherein the at least three peaks or shoulders include a peak or shoulder A having the smallest molecular weight Ma of 2,000 to 80,000, a peak or shoulder C having the largest molecular weight Mc satisfying, the relationship of $Mc/Ma \geqq 150$, and a peak or shoulder B having an intermediate molecular weight between the Ma and Mc.

The present invention further provides a toner comprising a colorant and a binder resin, the binder resin comprising a polymer having at least three peaks or shoulders in its chromatogram obtained by gel permeation chromatography, wherein the at least three peaks or shoulders include a peak or shoulder A having the smallest molecular weight Ma of 2,000 to 80,000, a peak or shoulder C having the largest molecular weight Mc satisfying, the relationship of $Mc/Ma \geqq 150$, and a peak or shoulder B having an intermediate molecular weight between the Ma and Mc.

The present invention according to another aspect thereof, provides a process for producing the binder resin for a toner as mentioned above, comprising; subjecting a mixture of a vinyl monomer and a crosslinking monomer to solution polymerization in an organic solvent capable of dissolving the polymerization product of the mixture in the presence of a polymerization initiator having a 10 hour - half life temperature of 100° C. or higher.

The present invention further provides a process for producing the binder resin for a toner as mentioned above, comprising: uniformly mixing a polymer having a weight-average molecular weight of $1\times10^3$ to $8\times10^4$, a polymer having a weight-average molecular weight of $3\times10^5$ to $10^6$ and a polymer having a weight-average molecular weight of $3\times10^6$ or larger.

The present invention, according to still another aspect thereof, provides a process for producing a toner, which comprises: melt-kneading a colorant and the above-mentioned binder resin, cooling the resultant mixture, and pulverizing and classifying the cooled mixture to obtain the toner.

These and other objects, features and advantages of the present invention will become more apparent upon a consideration of the following description concluding with specific examples and comparative examples taken in conjunction with the accompanying drawing.

BRIEF DESCRIPTION OF THE DRAWING

The sole FIGURE in the drawing shows a chromatogram of gel permeation chromatography of the resin obtained in Example 1.

DETAILED DESCRIPTION OF THE INVENTION

Critical features of the present invention for accomplishing the above objects are that the binder resin has at least three peaks or shoulders in its molecular weight distribution curve, that the molecular weight Ma of a peak or shoulder giving the smallest molecular weight is within the range of 2,000 to 80,000 and that the molecular weight Mc of a peak or shoulder giving the largest molecular weight and the above mentioned Ma gives a ratio Mc/Ma of 150 or larger.

According to a preferred embodiment of the present invention, at least one of the above-mentioned at least three peaks or shoulders is present in each of the three regions, namely a molecular weight region A of $2\times10^3$ to $8\times10^4$, molecular weight region B of $3\times10^5$ to $10^6$, and molecular weight region C of $3\times10^6$ or larger; and, when the heights of the peaks or shoulders in the three regions are denoted by Ha, Hb and Hc, respectively, these values satisfy the proportional relationship of Ha:Hb:Hc=1:0.2–1.0:0.1–0.6.

Among the components of the binder resin respectively present in the regions A, B and C, the component in the region B provides basic properties of a heat-fixable dry-system developer. The component in the region A is critical in improving the characteristic of fixation to a transfer material under heat and pressure. Further, the component in the region C functions to remarkably improve the anti-offset property of a toner against rollers during hot roller fixation and to improve the peelability or releasability from the rollers of a transfer material such as paper after fixation, and also plays an essential role in the durability in successive copying and adaptability to a variety of environments of a toner.

Furthermore, the ratio Mc/Ma between the molecular weight Mc giving the peak in the region C and the molecular weight Ma giving the peak in the region A, and the ratios among the heights Ha, Hb and Hc of the peaks respectively in the three regions, are also very important factors for further improving fixability under heat and pressure as well as anti-offset characteristic during hot-roller fixation and satisfying the durability in successive copying and adaptability to various environments.

The height H used herein of a peak or shoulder refers to a length of a perpendicular to the base line from each peak or shoulder on a chromatogram chart of GPC. For the case of a shoulder, the perpendicular from the point of flection of the shoulder to the base line gives the height.

A proposal for giving a toner with improved fixability by mixing a plurality of component binder resins having different molecular weight ranges has been made, but satisfactory binder resins have not yet been obtained. More specifically, the thus provided binder resin has not fully dissolved the problem of fixing performance or anti-offset characteristic during heat fixation by means of hot rollers but still involves some problem in respect of durability.

The Japanese Patent Laid-Open Application No. 82258/1983 discloses examples of binder resins having three peaks in the molecular weight distribution, but it is not always sufficient for a binder resin to have three peaks. For example, when the Ma/Mc values are calculated with respect to the binder resins having three peaks disclosed in the above-mentioned Laid-Open Application in the light of the present invention, they are all within the range of 20–90. Thus, the difference between the Ma and Mc is not sufficient, and a toner containing the resin can cause off-setting when the hot roller temperature is around 200° C. In contrast thereto, the binder resin of the present invention is characterized by having an Mc/Ma ratio of 150 or larger and having a sufficiently large difference between the Ma and Mc. As described hereinbefore, the Ma value relates to the fixing performance onto a transfer material or the minimum fixable temperature of a toner, and the Mc value relates to the high-temperature anti-offset characteristic onto hot rollers or the off-set initiating temperature of a toner. Accordingly, it is desired to decrease Ma so as to secure a lower fixing temperature and at the same time to increase Mc so as not to impair the anti-offset characteristic, whereby the fixation temperature range (i.e., temperature range applicable for fixation) is enlarged. From this point of view, the Mc/Ma ratio of 20 to 90 does not give a wide fixation temperature range but results in a toner with considerable room for improvement in various fixation characteristics. In contrast therewith, the Mc/Ma ratio of 150 or larger gives a toner with a sufficiently wide fixation temperature range and showing good overall fixation characteristics on hot roller fixation, which is sufficiently fixable with a relatively small amount of heat, almost free from offsetting onto hot rollers and capable of effecting smooth paper discharge from rollers. Further, the Mc value thus enlarged is also effective in improving the durability of a toner.

The peak in the region A of the binder resin according to the invention is a principal factor for determining the fixability under heat and pressure, in other words, the minimum fixable temperature on hot roller fixation. If the peak has a smaller molecular weight, the fixation temperature can be lowered which is desirable in respect of fixability. On the other hand, a smaller molecular weight for the peak in the region A results in poorer anti-offset characteristic onto rollers and poorer transfer paper-releasability during fixation. The molecular weight Ma for the peak in the region A is in the range of 2,000 to 80,000, preferably in the range of 2,000 to 40,000, and more preferably in the range of 5,000 to 20,000.

The peak in the high molecular weight region C is critical to the anti-offset characteristic and gives better overall characteristics in combination with and in compensation for each other with the peak in the region A as described above. In other words, a better fixability and a better anti-offset characteristic are harmonized in combination by the balance between the components of the regions A and C. For this purpose, the ratio Mc/Ma between molecular weights for the peaks in the respective regions is required to be 150 or larger and is further preferred to satisfy the following relationship:

$$-2.5\times10^2\times Ma+5.5\times10^6 \geqq Mc \geqq -5\times10^2\times Ma+1.5\times10^7$$

It is also to be noted that the ratios among the heights of the respective peaks in the regions A, B and C play an important role in improving the problems encountered with the conventional binder resins. If the molecular weights Ma, Mb and Mc of the peaks are referred to as qualitative factors, the heights Ha, Hb and Hc are quantitative factors, and the balance among Ha, Hb and Hc has a critical influence on the heat fixing characteristics and durability of a toner and the easiness of operation such as kneading under heat, pulverization, etc., for production of a toner.

The ratios among Ha:Hb:Hc are preferably 1:0.2–1.0:0.1–0.6 and more preferably 1:0.4–0.8:0.15–0.4. Too large Ha relative to Hb results in offsetting of a toner onto rollers and poor releasability of transfer paper, increase in agglomeration tendency and increased liability of deterioration during successive use of a toner. To the contrary, too small Ha relative to Hb results in poor fixability of a toner. Too large Hc relative to Hb results in poor fluidity of a toner on heating and fails to realize sufficient fixation. Further, the pulverizability is noticeably lowered thereby, so that the toner material containing the binder cannot be effectively pulverized into a desirable particle size for a toner on a commercial scale. To the contrary, too small Hc relative to Hb fails to ensure sufficient anti-offset characteristic and releasability of transfer paper during fixation.

A molecular weight in the region C, i.e., a molecular weight above three million cannot be measured accurately according to the gel permeation chromatography in the present state. Accordingly, the molecular weight values in this region used in the present invention have been obtained by extrapolation of a calibration curve obtained based on standard samples in the molecular weight range of upto around two million where accurate measurement is possible.

The binder resin for a toner according to the present invention having the above mentioned molecular weight distribution may be prepared by synthesis while adjusting the conditions therefor. Alternatively, the binder resin may be prepared by mixing a plurality of polymers, e.g., a polymer (A) having a peak or shoulder in the molecular weight range of $10^3$ to $8\times10^4$, a polymer (B) having a peak or shoulder in the molecular weight range of $3\times10^5$ to $10^6$, and a polymer (C) having a peak or shoulder in the molecular weight range of $3\times10^6$ or larger. When a plurality of polymers are mixed, the mixing ratios among the polymers A, B and C should desirably be as follows with the polymer B as the base polymer. The mixing weight ratio of the polymer A/the polymer B is desirably in the range of 5/1 to 1/1. The weight ratio of the polymer C/the polymer B is desirably in the range of 1:1 to 1/5. If the polymer A is too much relative to the polymer B, offsetting onto rollers occurs and releasability of transfer paper is deteriorated. To the contrary, if the polymer is too little, sufficient fixability of a toner cannot be obtained. If the polymer C is too much relative to the polymer B, fluidity of a toner on heating becomes worse and sufficient fixation cannot be effected. Further, the pulverization becomes noticeably difficult and a particle size adapted for a dry system developer cannot be effectively obtained by pulverization on a commercial scale. More specifically, an economically feasible range of productivity cannot be accomplished by an ordinary pulverizing means. To the contrary, if the polymer C is too little, sufficient releasability or anti-offset characteristic can not be ensured. The polymers A, B and C need not necessarily have the same composition but should desirably comprise the same monomer as the principal component, respectively.

The number of the peaks or shoulders contained in the chromatograph of the binder resin is not necessarily three but may be four or more. In the latter case, it is sufficient for three peaks or shoulders among them to satisfy the above mentioned requirements of the present invention.

As described hereinbefore, the binder resin of the present invention has a peak respectively in the three molecular weight regions A, B and C, and the peak molecular weights Ma and Mc satisfy the relationships of Ma=2,000–80,000 and Mc/Ma≧150. Herein, the chromatogram giving the molecular weight distribution is somewhat changed according to a measurement method adopted. In the present invention, the following method has been adopted for giving a chromatogram and a molecular weight of a resin, based on which the values for characterizing the inventions have been defined. Of course, other gel permeation chromatographic methods can be adopted for evaluation of a resin as far as they give substantially equivalent measurement values.

A chromatograph LC-3A provided with columns HSG 60, HSG 40 and HSG 15 arranged in series (available from Shimazu Seisakusho K. K.) is used at an over temperature of 40° C. While a solvent THF (tetrahydrofuran) is passed at a rate of 1.7 ml/min. under a fluid pressure of 90 kg/cm$^2$, 500 μl of a sample solution in THF at a concentration of 0.4 g/dl is injected. The sample solution is prepared by dissolving a sample resin in THF and passing the solution through a membrane filter (TM-2P 0.45 μm, produced by Toyo Roshi K. K.) and is injected one hour after the dissolution.

For the measurement of the molecular weight of a sample, a calibration curve is prepared by using 6 samples (Molecular Weights: 2,000,000; 600,000; 233,000; 50,000; 17,500; and 2,200; produced by Pressure Chemical Co.). Among the 6 standard samples, 3 samples (M.W.: 2,000,000; 233,000 and 17,500) are mixed in equal proportions and are made into a THF solution at a concentration of 0.4 g/dl, which is injected in a volume of 500 μl, 24 hours after the dissolution. Separately, the other 3 standard samples (M.W.: 600,000; 50,000 and 2,200) and also mixed in equal amounts into a 0.4 g/dl THF solution, which is them likewise injected. In the Examples and Comparative Examples described hereinafter, the analyzer used was a differential refractometer (RID-2A, produced by Shimazu Seisakusho K.K.).

The binder resin according to the invention can be prepared in the following processes.

Ordinary polymerization processes give a molecular weight distribution with a single peak. Accordingly, the following specific processes may preferably be adopted in order to produce the binder resin of the present invention. Those processes include a process wherein polymerization is carried out at stepwise different temperatures; a process wherein monomer mixtures containing different concentrations of initiators or chain transfer agents are intermittently added to a system to be polymerized; and a process wherein a crosslinking agent is intentionally added to a monomer mixture system to be polymerized. A process wherein polymerization conditions are controlled with the use of a crosslinking agent is a particularly preferred for the purpose of obtaining the resin of the present invention.

While these processes can be practiced by solution polymerization, suspension polymerization, emulsion polymerization, etc., the solution polymerization process is especially preferred for the reason that the molecular weight distribution can be controlled more easily. As another method, the resin having the desired molecular weight distribution can be obtained by mixing at a molecular level a plurality of resins including a resin of a relatively low molecular weight and a resin of a high molecular weight. More specifically, this is accomplished by a process wherein a plurality of resins of different molecular weights are dissolved in a solvent and, after sufficient mixing, the solvent is removed or by a process of melting such a plurality of resins under heating and blending the melted resins. In order to accomplish the objects of the present invention, it is preferred to obtain a resin having the ultimately objective molecular weight distribution in the polymerization stage.

A preferred process for producing the resin according to the present invention is as follows.

A mixture of vinyl monomers containing a crosslinking monomer is subjected to solution polymerization in the presence of an organic solvent capable of dissolving the copolymer of the vinyl monomer mixture and a polymerization initiator having a 10 hour-half life temperature, i.e., a temperature giving a half life of 10 hours, of 100° C. or higher. The solution polymerization is carried out at a temperature of 0°–40° C. higher than the 10 hour-half life temperature. Thus, a vinyl copolymer having the molecular weight distribution according to the invention is obtained.

The binder resin of the invention can be constituted by various components as far as they can constitute a toner resin and they can give the above mentioned molecular weight distribution. Especially, vinyl monomers are preferred to give vinyl copolymers.

Examples of the vinyl monomers applicable to the present invention include: styrene and its derivatives such as styrene, α-methylstyrene, and p-chlorostyrene; monocarboxylic acids and their derivatives such as acrylic acid, methyl acrylate, ethyl acrylate, butyl acrylate, dodecyl acrylate, octyl acrylate, phenyl acrylate, methacrylic acid, methyl methacrylate, ethyl methacrylate, butyl methacrylate, octyl methacrylate, acrylonitrile, and acrylamide; dicarboxylic acids having a double bond and their derivatives such as maleic acid, monobutyl maleate, dibutyl maleate, monomethyl maleate and dimethyl maleate; vinyl esters such as vinyl chloride, vinyl acetate, and vinyl benzoate; vinyl ketones such as vinyl methyl ketone and vinyl ethyl ketone; and vinyl ethers such as vinyl methyl ether, vinyl ethyl ether and vinyl isobutyl ether. These vinyl monomers are used alone or in a mixture. The binder resin of the invention may preferably be constituted by a styrene copolymer.

Such a vinyl copolymer giving the above mentioned chromatogram is preferred to constitute 60 % by weight or more, particularly 70 % by weight or more of the toner binder resin.

Selection of initiators, solvents and reaction conditons is important for obtaining the objective resin of the invention. Examples of the applicable initiators include organic peroxides such as, 1,1-(t-butylperoxy)-3,3,5-trimethylcyclohexane, n-butyl-4,4-di-(t-butylperoxy)-valerate, dicumyl peroxide, α,α'-bis(t-butylperoxydiisopropyl)benzene, t-butylperoxycumene and di-t-butylperoxide; and azo and diazo compounds such as diazoaminoazobenzene. Particularly useful class of polymerization initiators are those having a 10 hour-half life temperature of 100° C. or above as mentioned hereinbefore. Especially, di-t-butyl peroxide is effective. In this instance, the polymerization temperature is preferably selected at a temperature higher than the 10 hour-half life temperature by 0°–40° C. and accordingly a solvent adapted to the temperature is preferably selected.

Generally, the molecular weight Ma decreases, as the amount of the initiator increases, as the concentration of the monomer in the reaction system is decreased relative to the solvent, and as the reaction time is prolonged. Further, as the concentration of the crosslinking monomer increases, the molecular weight Mc increases and the height Hc increases.

The copolymer should preferably be crosslinked to some extent to give better anti-offset characteristic. There are various methods of causing some degree of crosslinking. For example, the above mentioned method of effecting copolymerization in the presence of a crosslinking monomer to obtain a vinyl copolymer is an effective method.

The crosslinking monomer may chiefly be compounds having two or more polymerizable double bonds. Examples of such compounds include: aromatic divinyl compounds such as divinylbenzene and divinylnaphthalene; carboxilic acid esters having two double bonds such as ethylene glycol diacrylate, ethylene glycol dimethacrylate, and 1,3-butanediol dimethacrylate; divinyl compounds such as divinylaniline, divinyl ether, divinyl sulfide and divinyl sulfone; and compounds having three or more vinyl groups. Among these, divinylbenzene is particularly useful.

Such a crosslinking monomer should preferably be contained in 0.2 to 5 parts by weight, particularly 0.8 to 2.5 parts by weight, in 100 parts by weight of the vinyl monomer mixture.

The binder resin of the invention should preferably have a softening point according to the ring and ball test of the order of 100° to 150° C., while it varies to some extent depending on the monomers and composition thereof. The glass transition temperature may preferably be in the range of 40° to 80° C., and, more preferably, 50° to 60° C. If the softening point is below 100° C., the toner causes filming to soil the photosensitive member or readily deteriorates during successive copying. If it exceeds 150° C., fixation efficiency is lowered due to increase in fixable temperature, and the pulverization efficiency is also decreased. If the glass transition temperature is lower than 40° C., thermal agglomeration or caking of the toner can readily occur during storage of the toner, so that agglomeration trouble can occur also in a copying machine. To the contrary, if the glass transition temperature exceeds 80° C., the heat fixation efficiency becomes worse.

The binder resin of the present invention should preferably have an M.I. (melt index) in the range of 0.25 to 5 under the conditions of 125° C. and 2160 g and more preferably in the range of 1.2 to 4. An M.I. of below 0.5 leads to increase in fixation temperature and decrease in fixation efficiency of the toner. If the M.I. is larger than 5, offsetting onto rollers readily occurs during high temperature fixation.

The softening point (S.P.) of the ring and ball method is based on the values obtained according to JIS K 2531 and the melt index (M.I.) according to JIS K 7210. The glass transition temperature (Tg) is based on the values obtained by means of a differential thermal analyzer DTA-30M (available from Shimazu Seisakusho K. K.) under the conditions of a temperature raising rate of 15° C./min. and a sample weight of 10 to 15 mg.

The toner for a developer of the invention can contain other resinous compounds in addition to the above mentioned binder resin according to the invention in a proportion less than the latter. Examples of such resinous compounds include silicone resin, polyester, polyurethane, polyamide, epoxy resin, polyvinylbutyral, rosin, modified rosin, terpene resin, aliphatic or alicyclic hydrocarbon resin, aromatic petroleum resin, chlorinated paraffin, and paraffin wax.

When a magnetic toner is produced, magnetic particles are contained in the toner. The magnetic particles may be a material which shows magnetism by itself or which is magnetizable. Examples of such materials include metals such as iron, manganese, nickel, cobalt and chromium, magnetite, hematite, various ferrites, manganese alloys, and other ferromagnetic alloys. The magnetic particles may be obtained by rendering these materials into fine particles having an average particle size of about 0.05 to 5μ, more preferably 0.1 to 2μ. A magnetic toner should preferably contain such magnetic particles in a proportion of 1.5 to 70 %, particularly 25 to 45 % of the total toner weight.

The toner of the present invention can further contain a colorant, a charge controller agent, or a flowability improver. Examples of such materials include carbon black, iron black, graphite, nigrosine, metal complexes of monoazo dyes, Hansa Yellow, Benzidine Yellow, Quinacridone and various lake pigments.

A flowability improver such as hydrophobic colloidal silica may be externally mixed with the toner particles. The flowability improver may be added in an amount of 0.05 to 5 wt. %, preferably 0.1 to 2 wt. %, of the toner.

The toner produced from the above mentioned binder resin, magnetic particles colorant, charge controller agent, etc., is highly resistant to a load applied in a developing apparatus and is very seldom deteriorated due to crushing during durability test. On the other hand, it is desirable to add a small amount of an olefinic homopolymer or copolymer having a melt viscosity at 140° C. of 10 to $10^6$ cps, more preferably $10^2$ to $10^5$ cps, in order to prevent abrasion of or damage to the surface of a photosensitive member, a cleaning member, the surface of a developing sleeve, carrier particles, etc. When such an additive is externally added to the toner particles, a weight ratio thereof to the toner can vary to change developing characteristics during repetitive use. For this reason, the additive is preferably incorporated in the toner. If the olefinic polymer is contained in the developer powder in a proportion of 0.5 to 5 wt. %, the dispersibility and compatibility of pigment or magnetic particles with respect to the toner are improved, and good effects for the surface of a photosensitive member, a cleaning member, etc., are attained. Examples of the olefinic homopolymer or copolymer used for this purpose include polyethylene, polypropylene, ethylene-propylene copolymer, ethylene-vinyl acetate copolymer, ethylene-ethyl acrylate copolymer and ionomer resin having a polyethylene base structure. When an olefinic copolymer is used, the copolymer should preferably contain 50 mol. % or more, more preferably 60 mol. % or more of olefin monomer units.

The melt viscosities have been measured according to the Brookfield method and with a Brookfield viscometer provided with an adaptor for a small amount sample.

An electrophotographic process using the toner of the present invention will be explained hereinbelow.

There are various methods for developing electric latent images with a toner, such as the magnetic brush method as mentioned above, the cascade method, the powder cloud method, a method wherein an electroconductive magnetic toner is used as disclosed in U.S. Pat. No. 3,909,258, and a method wherein a high resistivity magnetic toner is used as disclosed in Japanese Patent Laid-Open Application No. 31136/1978. A developer obtained by using the resin of the present invention is also suitable for a developing method using a so-called one-component developer containing magnetic particles.

In a step of transferring a developed image to a part to be transfer-printed, various systems may be adopted such as the corona transfer system, the bias transfer system, an electrostatic transfer system such as a system using an electroconductive roller, and a system using a magnetic field for the transfer.

Residual toner on the photosensitive layer or insulating layer may be removed by the blade cleaning system or the fur brush cleaning system.

Powder image on a transfer-printed member should be fixed, for example by the heat fixing method, the solvent fixing method, the flash fixing method, or the laminate fixing method. In order to fully exhibit the characteristics of the toner according to the invention, the hot roller fixing method is preferably adopted.

As described in detail hereinabove, according to the present invention, there is provided a resin for a toner having at least three peaks or shoulders in its molecular weight distribution curve and a specific molecular weight difference between two peaks or shoulders respectively giving the largest and smallest molecular weights. By using the toner, there is further obtained a toner which is particularly excellent in harmonization of fixability, anti-offset characteristic and durability.

The present invention will be described more specifically hereinbelow by referring to the examples and comparative examples, wherein "parts" means "parts by weight".

EXAMPLE 1

| Mixture | Quantity |
|---|---|
| Styrene | 414 g (69 parts) |
| n-Butyl acrylate | 141 g (23.5 parts) |
| Monobutyl maleate | 36 g (6 parts) |
| Divinylbenzene | 8.4 g (1.4 parts) |
| Di-t-butyl peroxide | 6.0 g (1.0 parts) |

Into a 2 liter-4-neck round-bottom blask provided with a thermometer, a nitrogen-introductory tube, a stirrer and a water-cooled Dimroth condenser, 420 g of xylene was charged and heated to the reflux temperature of xylene on an oil bath provided with a heater. Into the xylene under reflux was added the above mixture dropwise in 3 hours and 20 minutes. After the dropwise addition, polymerization was conducted for 4 hours. Then, the solvent was removed by ordinary reduced-pressure distillation to recover a polymerization product.

The copolymer thus obtained had a chromatogram according to gel permeation chromatography as shown in the attached drawing and had peaks at molecular weights of 13,000; 870,000; and 4,500,000, indicating an Mc/Ma of 346 and Ha/Hb/Hc or 1/0.5/0.2. The polymer obtained also had a Tg of 57° C. and M.I. of 2.3.

EXAMPLE 2

Polymerization was conducted in the same manner as in Example 1 except that the n-butyl acrylate was replaced by 2-ethylhexyl acrylate and the following mixture was used.

| Mixture | Quantity |
|---|---|
| Styrene | 435 g (75.7 parts) |
| 2-Ethylhexyl acrylate | 102 g (17 parts) |
| Monobutyl maleate | 36 g (6 parts) |
| Divinylbenzene | 8.4 g (1.4 parts) |
| Di-t-butyl peroxide | 6.0 g (1.0 parts) |

The properties of the copolymer obtained are summarized in Table 1B appearing hereinafter.

EXAMPLES 3-7, COMPARATIVE EXAMPLES 1-3

The compositions of monomer mixtures and polymerization conditions of these examples are summarized in the following Table 1A and the results in Table 1B, together with those of Examples 1 and 2. The operation procedure of these examples was substantially the same as that of Example 1 explained above.

TABLE 1A

| | List of Examples (Synthesis) | | | | | | | |
|---|---|---|---|---|---|---|---|---|
| | Monomers (parts) | | | | | | | |
| | 1 | 2 | 3 | 4 | Initiator | Solvent | Temperature | Time |
| Example | | | | | | | | |
| 1 | Styrene (69) | BA (23.5) | MB (6) | DVB (1.4) | DBPO 1.0 | Xylene 70 | Reflux temperature | 3 hr. 20 min. |
| 2 | Styrene (75.5) | 2EHA (17) | MB (6) | DVB (1.4) | DBPO 1.0 | Xylene 70 | Reflux temperature | 3 hr. 20 min. |
| 3 | Styrene (70) | BA (23.5) | MB (6) | DVB (0.55) | DBPO 0.5 | Xylene 50 | Reflux temperature | 3 hr. 20 min. |
| 4 | Styrene (76.5) | 2EHA (17) | MB (6) | DVB (0.55) | DBPO 0.5 | Xylene 50 | Reflux temperature | 3 hr. 20 min. |
| 5 | Styrene (69.5) | BA (20) | MB (6) | DVB (4.5) | DBPO 4 | Xylene 100 | Reflux temperature | 4 hr. |
| 6 | Styrene (74.5) | 2EHA (15) | MB (6) | DVB (4.5) | DBPO 4 | Xylene 100 | Reflux temperature | 4 hr. |
| 7 | Styrene (71.5) | LMA (18) | MB (6) | DVB (4.3) | DBPO 4 | Xylene 100 | Reflux temperature | 4 hr. |
| Comparative Example | | | | | | | | |
| 1 | Styrene (70) | BA (23.5) | MB (6) | DVB (0.15) | DBPO 2 | Toulene 100 | Reflux temperature | 3 hr. 20 min. |
| 2 | Styrene (70) | BA (23.5) | MB (6) | DVB (0.48) | DBPO 0.5 | Xylene 50 | Reflux temperature | 3 hr. 20 min. |
| 3 | Styrene (70) | BA (20) | MB (6) | DVB (3.7) | DBPO 4 | Xylene 100 | Reflux temperature | 4 hr. |

BA — butyl acrylate
2EHA — 2-ethylhexyl acrylate
LMA — lauryl methacrylate
MB — monobutyl maleate
DVB — divinylbenzene
DBPO — di-t-butylperoxide

TABLE 1B

| | Tg | MI | Peak molecular weight ($\times 10^3$) Ma | Mb | Mc | Mc/Ma | Ha/Hb/Hc |
|---|---|---|---|---|---|---|---|
| Example | | | | | | | |
| 1 | 57° C. | 2.3 | 13 | 870 | 4500 | 346 | 1/0.5/0.2 |
| 2 | 56 | 2.2 | 14 | 800 | 4300 | 307 | 1/0.5/0.2 |
| 3 | 65 | 1.4 | 23 | 950 | 4100 | 178 | 1/0.8/0.15 |
| 4 | 64 | 1.3 | 25 | 930 | 3900 | 156 | 1/0.7/0.2 |
| 5 | 62 | 2.5 | 9 | 700 | 6500 | 722 | 1/0.4/0.6 |
| 6 | 61 | 3.0 | 9 | 720 | 6800 | 756 | 1/0.4/0.5 |
| 7 | 62 | 2.5 | 10 | 690 | 7000 | 700 | 1/0.4/0.6 |
| Comparative Example | | | | | | | |
| 1 | 64 | 0.7 | 52 | 610 | 2100 | 40 | 1/0.6/0.05 |
| 2 | 63 | 2.5 | 31 | 630 | — | — | 1/0.5/— |
| 3 | 59 | 7.5 | 9 | 600 | — | — | 1/0.7/— |

EXAMPLES 8-11, COMPARATIVE EXAMPLES 4-5

Resins according to the present invention and comparative resins were respectively obtained by uniformly mixing a plurality of polymers as shown in the following Table 2A.

More specifically, in each example, a plurality of polymers were respectively dissolved in toluene and the resultant solutions were uniformly mixed so as to effect mixing at molecular level. Then, the solvent toluene was removed by reduced pressure distillation to leave a resin mixture.

The measured properties of the resultant resin mixtures are shown in Table 2B.

TABLE 2A

| | List of Examples (Mixing) | | | |
|---|---|---|---|---|
| | Polymer species | Monomer mole ratio | Average M.W. ($\times 10^4$) | Weight % |
| Example | | | | |

TABLE 2A-continued

| | List of Examples (Mixing) | | | |
|---|---|---|---|---|
| | Polymer species | Monomer mole ratio | Average M.W. ($\times 10^4$) | Weight % |
| 8 | Sytrene-BA copolymer | 72/28 | 6.2 | 65 |
| | Styrene-BA copolymer | 72/28 | 60 | 25 |
| | Styrene-2EHA copolymer | 75/25 | 220 | 10 |
| 9 | Styrene-BA copolymer | 70/30 | 1.8 | 60 |
| | Styrene-BA copolymer | 72/28 | 65 | 32 |
| | Styrene-BA copolymer | 70/30 | 260 | 8 |
| 10 | Styrene-BA copolymer | 70/30 | 2.4 | 50 |
| | Styrene-BA-MB copolymer | 70/25/5 (two peaks) | 140 | 50 |
| 11 | Styrene-BA-MA copolymer | 70/24/6 (two peaks) | 120 | 88 |
| | Styrene-BA copolymer | 80/20 | 360 | 12 |
| Comparative Example | | | | |
| 4 | Styrene-BA copolymer | 72/28 | 2.5 | 75 |
| | Styrene-BA copolymer | 65/35 | 50 | 25 |
| | Styrene-BA copolymer | 70/30 | 8 | 65 |
| | Styrene-BA copolymer | 70/30 | 30 | 25 |
| | Styrene-BA copolymer | 65/35 | 115 | 10 |
| 6 | Styrene-BA copolymer | 65/35 | 1.25 | 60 |
| | Styrene-BA copolymer | 65/35 | 20.5 | 30 |
| | Styrene-BA copolymer | 65/35 | 115 | 10 |

BA — butyl acrylate
MB — monobutyl maleate
2EHA — 2-ethylhexyl acrylate

TABLE 2B

| | Ma | Mb | Mc | Mc/Ma | Ha | Hb | Hc/Tg/MI |
|---|---|---|---|---|---|---|---|
| Example | | | | | | | |
| 8 | 12 | 410 | 3200 | 267 | 1 | 0.4 | 0.17/57/1.6 |
| 9 | 14 | 520 | 3900 | 279 | 1 | 0.6 | 0.21/59/2.1 |
| 10 | 12 | 500 | 4500 | 375 | 1 | 0.5 | 0.27/62/1.4 |
| 11 | 15 | 520 | 5100 | 365 | 1 | 0.56 | 0.16/57/2.8 |
| Comparative Example | | | | | | | |
| 4 | 14 | 860 | — | — | 1 | 0.3 | —/60/3.2 |
| 5 | 56 | 220 | 1050 | 19 | 1 | 0.4 | 0.3/59/1.1 |
| 6 | 13.3 | 221 | 1200 | 90 | 1 | 0.43 | 0.21/56/3.8 |

EXAMPLE 12

One hundred parts of the resin of Example 1 having been crushed into sizes passing through a mask of 2 mm in opening was blended with 65 parts of magnetic particles (Magnetite EPT 1000 produced by Toda Kogyo K. K.), 2 parts of a metal complex dye (E-81 produced by Orient Kagaku K. K.) as a charge controller agent, and 4 parts of low-molecular weight polypropylene (Viscol 660P produced by Sanyo Kasei Kogyo K. K.) by means of a Henschel mixer, and kneaded on a roll mil under melting.

After cooling, the mixture was coarsely crushed by means of a hammer mil and then pulverized by means of an ultrasonic jet pulverizer. The produce was then classified by a wind power classifier to collect particles with sizes in the range of 5–35$\mu$. With 100 parts of the particles thus collected, 0.4 part of hydrophobic colloidal silica powder was mixed to give a toner, which was then used for image formation.

For the image formation, a commercially available plain paper copier (NP-500RE produced by Canon K. K. and the resultant toner image was fixed on a prescribed copy paper by means of hot rollers of standard specification.

The copied image obtained was good without fog in the initial stage of a successive copying test and also was sufficiently good even after 20,000 sheets of a running test. After the test, no damage nor fusion sticking of the toner was observed at the photosensitive drum, the cleaning unit and the developing sleeve.

The toner showed an excellent fixability which was of no problem even in 50,000 sheets of a running test, in which no jamming was caused by wrapping of paper onto rollers in the stage of paper discharge. Thus, the toner was satisfactory as a whole. Further, in a start-up and continuous copying test in the environment of 10° C., no trouble was caused by insufficient fixability. On the other hand, undesirable offsetting did not occur even when a part of hot fixation rollers reached a temperature of above 200° C.

EXAMPLE 13

Example 12 was repeated except that 100 parts of the resin of Example 3 was used, whereby similarly good results were obtained as in Example 12.

EXAMPLES 14–17, COMPARATIVE EXAMPLES 7–10

Example 12 was repeated except that the resin was replaced as shown in the following Table 3A. The results are shown in Table 3B together with those of Examples 12 and 13.

TABLE 3A

| | Resin | magnetic powder | charge controller | release agent |
|---|---|---|---|---|
| Example | | | | |
| 12 | Example 1 (100 parts) | ETP-1000 65 parts | E-81 2 parts | 660-P 4 parts |
| 13 | Example 3 (100 parts) | ETP-1000 65 parts | E-81 2 parts | 660-P 4 parts |
| 14 | Example 4 (100 parts) | ETP-1000 65 parts | E-81 2 parts | 660-P 4 parts |
| 15 | Example 7 (100 parts) | ETP-1000 65 parts | E-81 2 parts | 660-P 4 parts |
| 16 | Example 8 (100 parts) | ETP-1000 65 parts | E-81 2 parts | 660-P 4 parts |
| 17 | Example 10 (100 parts) | ETP-1000 65 parts | E-81 2 parts | 660-P 4 parts |
| Comparative Example | | | | |
| 7 | Comparative Example 1 (100 parts) | ETP-1000 65 parts | E-81 2 parts | 660-P 4 parts |
| 8 | Comparative | ETP-1000 | E-81 | 660-P |

TABLE 3A-continued

| | Resin | magnetic powder | charge controller | release agent |
|---|---|---|---|---|
| | Example 2 (100 parts) | 65 parts | 2 parts | 4 parts |
| 9 | Comparative Example 3 (100 parts) | ETP-1000 65 parts | E-81 2 parts | 660-P 4 parts |
| 10 | Comparative Example 4 (100 parts) | ETP-1000 65 parts | E-81 2 parts | 660-P 4 parts |
| 11 | Comparative Example 6 (100 parts) | ETP-1000 65 parts | E-81 2 parts | 660-P 4 parts |

TABLE 3B

| | Developing durability | Fog-ging | Toner M.I. *1 | Minimum fixable temp. *2 | Offset gener-ation temp. |
|---|---|---|---|---|---|
| Example | | | | | |
| 12 | 20,000 sheets Good | None | 1.8 | 135° C. | above 200° C. |
| 13 | 20,000 sheets Good | None | 1.2 | 140 | above 200° C. |
| 14 | 20,000 sheets Good | None | 1.0 | 140 | above 200° C. |
| 15 | 20,000 sheets Good | None | 2.2 | 135 | above 200° C. |
| 16 | 20,000 sheets Good | None | 1.5 | 135 | above 200° C. |
| 17 | 20,000 sheets Good | None | 1.2 | 140 | above 200° C. |
| Comparative Example | | | | | |
| 7 | 20,000 sheets Good | None | 1.4 | 150 | 195° C. |
| 8 | 20,000 sheets Good | None | 1.1 | 145 | 190° C. |
| 9 | *3 | Not good | 4.8 | 130 | 180 |
| 10 | 20,000 sheets Good | None | 2.8 | 140 | 180 |
| 11 | 20,000 sheets Good | None | 3.4 | 135 | 180 |

*1: The toner M.I. was measured under the conditions of 125° C., 10 kg.
*2: The fixability was evaluated by using the fixer of a copier NP-400RE (produced by Canon K.K.) with modification so as to be set at variable temperatures.
*3: Image density decreased during durability test.

What is claimed is:

1. A binder resin for a toner comprising a polymer having at least three peaks or shoulders in its chromatogram obtained by gel permeation chromatography, wherein said at least three peaks or shoulders include a peak or shoulder A having the smallest molecular weight Ma of 2,000 to 80,000, a peak or shoulder C having the largest molecular weight Mc of $3\times10^6$ or larger satisfying the relationship of $Mc/Ma \geqq 150$, and a peak or shoulder B having an intermediate molecular weight Mb between said Ma and Mc of $3\times10^5$ to $1\times10^6$, wherein said peaks or shoulders A, B and C have heights Ha, Hb and Hc, respectively, which satisfy the proportion Ha:Hb:Hc of 1:0.2–1.0:0.1–0.6.

2. The binder resin according to claim 1, wherein said peak or shoulder B has a molecular weight Mb of $3\times10^5$ to $1\times10^6$.

3. The binder resin according to claim 1, wherein said peak or shoulder C has a molecular weight of $3\times10^6$ or larger.

4. The binder resin according to claim 1, wherein said peaks or shoulders A, B and C have heights Ha, Hb and Hc, respectively, aatisfying the proportional relationship of Ha:Hb:Hc of 1:0.2–1.0:0.1–0.6.

5. The binder resin according to claim 1, wherein the molecular weight Ma is 2,000 to 40,000.

6. The binder resin according to claim 1, wherein said polymer is a vinyl polymer.

7. The binder resin according to claim 1, which comprises a mixture of a plurality of polymers, said plurality of polymers in combination giving said at least three peaks in the chromatogram.

8. The binder resin according to claim 1, wherein said polymer has a melt index of 0.25 to 5.

9. The binder resin according to claim 1, wherein said polymer has a softening point of from 100° to 150° C.

10. The binder resin according to claim 1, wherein said polymer has a glass transition point of from 40 to 80° C.

11. The binder resin according to claim 1, wherein the polymer is contained in the binder in an amount of 60% or more by weight.

12. A toner composition for development, comprising a colorant and a binder resin, said binder resin comprising a polymer having at least three peaks or shoulders in its chromatogram obtained by gel permeation chromatography, wherein said at least three peaks or shoulders include a peak or shoulder A having the smallest molecular weight Ma of 2,000 to 80,000, a peak or shoulder C having the largest molecular weight Mc of $3\times10^6$ or larger satisfying the relationship of $Mc/Ma \geqq 150$, and a peak or shoulder B having an intermediate molecular weight Mb between said Ma and Mc of $3\times10^5$ to $1\times10^6$ wherein said peaks or shoulders A, B and C have heights Ha, Hb, and Hc, respectively, which satisfy the proportion Ha:Hb:Hc of 1:0.2–1.0:0.1–0.6.

13. The toner composition according to claim 12, wherein said peak or shoulder B has a molecular weight Mb of $3\times10^5$ to $1\times10^6$.

14. The toner composition according to claim 12, wherein said peak or shoulder C has a molecular weight of $3\times10^6$ or larger.

15. The toner composition according to claim 12, wherein said peaks or shoulders A, B and C have heights Ha, Hb and Hc, respectively, satisfying the proportional relationships of Ha:Hb:Hc of 1:0.2 to 1.0:0.1 to 0.6.

16. The toner composition according to claim 12, wherein the molecular weight Ma is 2,000 to 40,000.

17. The toner composition according to claim 12, wherein said polymer is a vinyl polymer.

18. The toner composition according to claim 1, which comprises a mixture of a plurality of polymers, said plurality of polymers in combination giving said at least three peaks in the chromatogram.

19. The toner composition according to claim 12, wherein said polymer has a melt index of 0.25 to 5.

20. The toner composition according to claim 12, wherein said polymer has a softening point of from 100° to 150° C.

21. The toner composition according to claim 12, wherein said polymer has a glass transition point of from 40° to 80° C.

22. A process for producing a binder resin according to claim 1, comprising: subjecting a mixture of a vinyl monomer and a crosslinking monomer to suspension polymerization in an organic solvent capable of dissolving the polymerization product of the mixture in the presence of a polymerization initiator having a 10 hour-half life temperature of 100° C. or higher.

23. The process according to claim 22, wherein said vinyl monomer is selected from the group consisting of styrene, α-methylstyrene, p-chlorostyrene, acrylic acid, methyl acrylate, ethyl acrylate, butyl acrylate, dodecyl acrylate, octyl acrylate, phenyl acrylate, methacrylic acid, methyl methacrylate, ethyl methacrylate, butyl methacrylate, octyl methacrylate, acrylonitrile, acrylamide, maleic acid, monobutyl maleate, dibutyl maleate, monomethyl maleate, dimethyl maleate, vinyl chloride, vinyl acetate, vinyl benzoate, vinyl methyl ketone, vinyl ethyl ketone, vinyl methyl ether, vinyl ethyl ether, vinyl isobutyl ether, and a mixture thereof.

24. The process according to claim 22, wherein said crosslinking monomer is a compound having two or more polymerizable double bonds.

25. The process according to claim 23, wherein said crosslinking monomer is a compound selected from the group consisting of divinylbenzene, divinylnaphthalene, ethylene glycol diacrylate, ethylene glycol dimethacrylate, 1,3-butanediol dimethacrylate, divinylaniline, divinyl ether, divinyl sulfide, divinyl sulfone, and a mixture thereof.

26. The process according to claim 22, wherein said polymerization initiator is selected from the group consisting of 1,1-(t-butylperoxy)-3,3,5-trimethylcyclohexane, n-butyl-4,4-di-(t-butylperoxy)valerate, dicumyl peroxide, α,α'-bis(t-butylperoxydiisopropyl)benzene, t-butylperoxycumene, di-ti-butylperoxide, and diazoaminoazobenzene.

27. The process according to claim 22, wherein said solution polymerization is carried out at a temperature higher than the 10 hour-half life temperature of the polymerization initiator by 0°–40° C.

28. The toner according to claim 12, wherein the polymer is container in the binder resin in an amount of 60% or more by weight.

29. A process for producing a binder resin for toner, comprising uniformly mixing a polymer having a weight-average molecular weight of $1\times10^3$ to $8\times10^4$, a polymer having a weight-average molecular weight of $3\times10^5$ to $10^6$ and a polymer having a weight-average molecular weight of $3\times10^6$ or larger, to form a polymer mixture having at least three peaks or shoulders in its chromatogram obtained by gel permeation chromatography, wherein said at least three peaks or shoulders include a peak or shoulder A having the smallest molecular weight Ma of 2,000 to 80,000, a peak or shoulder C having the largest molecular weight Mc satisfying, the relationship of $Mc/Ma \geqq 150$, and a peak or shoulder B having an intermediate molecular weight between said Ma and Mc.

30. The process according to claim 29, wherein the mixing of the polymers are carried out by mixing the polymers each in solution, and the solvent is evaporated off from the resultant solution mixture to recover the polymer mixture.

31. The process according to claim 29, wherein the peak or shoulder A has a molecular weight Ma of 2,000 to 80,000, the peak or shoulder B has a molecular weight Mb of $3\times10^5$ to $1\times10^6$ and the peak or shoulder C has a molecular weight Mc of $3\times10^6$ or larger, wherein said peaks or shoulders A, B and C have heights Ha, Hb and Hc, respectively, which satisfy the proportion Ha:Hb:Hc of 1:0.2–1.0: 0.1–0.6.

32. A process for producing a toner, comprising:

melt-kneading a colorant and a binder resin, said binder resin comprising a polymer having at least three peaks or shoulders in its chromatogram obtained by gel permeation chromatography, wherein said at least three peaks or shoulders include a peak or shoulder A having the smallest molecular weight Ma of 2,000 to 80,000, a peak or shoulder C having the largest molecular weight Mc satisfying the relationship of $Mc/Ma \geqq 150$, and a peak or shoulder B having an intermediate molecular weight between said Ma and Mc, cooling the resultant mixture, and pulverizing and classifying the cooled mixture to obtain said toner.

33. The process according to claim 32, wherein the peak or shoulder A has a molecular weight Ma of 2,000 to 80,000, the peak or shoulder B has a molecular weight Mb of $3\times10^5$ to $1\times10^6$ and the peak or shoulder C has a molecular weight Mc of $3\times10^6$ or larger, wherein said peaks or shoulders A, B and C have heights Ha, Hb and Hc, respectively, which satisfy the proportion Ha:Hb:Hc of 1:0.2–1.0: 0.1–0.6.

34. The process according to claim 32, wherein the polymer is contained in the binder resin in an amount of 60% or more by weight.

* * * * *

UNITED STATES PATENT AND TRADEMARK OFFICE

CERTIFICATE OF CORRECTION

PATENT NO. : 4,626,488

DATED : December 2, 1986

INVENTOR(S) : SUKEJIRO INOUE

It is certified that error appears in the above-identified patent and that said Letters Patent is hereby corrected as shown below:

COLUMN 2

Line 32, "decreased, or maintenance" should read --decreased maintenance, or maintenance--.

COLUMN 6

Line 68, "$10^6 \geqq Mc \geqq -5$" should read --$10^6 \leqq Mc \leqq -5$--.

COLUMN 7

Line 14, "15-0.4." should read --0.15-0.4.--.
Lines 52-53, "5/1 to 1/1." should read --5:1 to 1:1.--
Line 54, "1/5." should read --1:5--.

COLUMN 10

Line 28, "carboxilic" should read --carboxylic--.

COLUMN 13

Line 51, "Toulene" should read --Toluene--.

COLUMN 15

Line 18, " Styrene-BA copolymer 70/30" should read --5 Styrene-BA copolymer 70/30--.

COLUMN 17

Lines 36-39, "180 " should read --180°C.--.
180 180°C.
180 180°C.

UNITED STATES PATENT AND TRADEMARK OFFICE

CERTIFICATE OF CORRECTION

PATENT NO. : 4,626,488

DATED : December 2, 1986

INVENTOR(S) : SUKEJIRO INOUE

It is certified that error appears in the above-identified patent and that said Letters Patent is hereby corrected as shown below:

COLUMN 17

Line 67, "aatisfying" should read --satisfying--.

COLUMN 18

Line 14, "40 to" should read --40° to--.
Line 62, "suspension" should read --solution--.

COLUMN 19

Line 26, "di-ti-butylperoxide" should read --di-t-butylperoxide--.

COLUMN 20

Line 2, "satisfying," should read --satisfying--.

Signed and Sealed this

Fifteenth Day of September, 1987

*Attest:*

*Attesting Officer*

DONALD J. QUIGG

*Commissioner of Patents and Trademarks*

UNITED STATES PATENT AND TRADEMARK OFFICE

CERTIFICATE OF CORRECTION

PATENT NO. : 4,626,488

DATED : December 2, 1986

INVENTOR(S) : SUKEJIRO INOUE

It is certified that error appears in the above-identified patent and that said Letters Patent is hereby corrected as shown below:

COLUMN 8

Line 28, "over" should read --oven--.

Signed and Sealed this

Thirty-first Day of January, 1989

*Attest:*

DONALD J. QUIGG

*Attesting Officer*

*Commissioner of Patents and Trademarks*